US005176259A

United States Patent [19]

Andersen

[11] Patent Number: 5,176,259

[45] Date of Patent: Jan. 5, 1993

[54] UTILITY TRAY WITH FLEXIBLE STRAP FASTENERS

[76] Inventor: Karsten Andersen, 7101 Salerno St., San Diego, Calif. 92111

[21] Appl. No.: 884,151

[22] Filed: May 18, 1992

[51] Int. Cl.[5] ..... A47B 83/02

[52] U.S. Cl. ..... 206/557; 248/205.2; 297/153

[58] Field of Search ..... 206/557; 108/50, 161; 248/205.2; 297/148-155

[56] References Cited

U.S. PATENT DOCUMENTS

| | | | |
|---|---|---|---|
| 1,725,508 | 8/1929 | Bell-Clifford . | |
| 2,418,731 | 4/1947 | Seitz | 297/152 |
| 2,647,716 | 8/1953 | Hudziak et al. . | |
| 2,867,401 | 1/1959 | Sheahan . | |
| 2,919,748 | 1/1960 | Alden, Sr. | 297/153 |
| 3,185,113 | 5/1965 | Nathan . | |
| 3,515,429 | 6/1970 | Bollinger | 297/153 |
| 4,181,358 | 1/1980 | Pennington | 297/148 |
| 4,632,451 | 12/1986 | Lee | 297/153 |
| 4,867,506 | 9/1989 | Chavez | 297/153 |
| 4,906,043 | 3/1990 | Davis et al. | 297/153 |
| 5,038,451 | 8/1991 | Smith | 297/153 |
| 5,106,156 | 4/1992 | Marquis | 297/148 |

*Primary Examiner*—Jimmy G. Foster

[57] ABSTRACT

A rigid utility surface tray (10) with two flexible strap fasteners (12*a*), (12*b*) and a fixed fastener (14). The utility tray is supported by and secured to two horizontal structural supports, such as open chair arms. The flexible strap fasteners (12*a*), (12*b*) secure utility tray (10) by encircling horizontal structural supports and fastening to the fixed fastener (14).

5 Claims, 5 Drawing Sheets

View A

View B

View A

View B

View A

View B

UTILITY TRAY WITH FLEXIBLE STRAP FASTENERS

BACKGROUND

1. Field of Invention

This invention is an article of manufacture in the form of a utility tray which is specifically designed to be supported by both armrests of a typical folding or fixed chair and secured to both armrests by two flexible strap fasteners.

2. Description of Prior Art

Heretofore, support surfaces or utility trays with hardware for securing to a chair have been limited to attachment to only one arm rest of a chair. The configuration of various securing hardware require that the arm rest be solid with rigid side walls.

U.S. Pat. No. 1,725,508 to S. Bell-Clifford (Aug. 20, 1929) requires a solid arm rest, such as found on a Davenport chair, to drape a strap support over. The support is secured to one arm rest only by a sufficient coefficient of friction between the strap and the chair arm. Adequate coefficient of friction is not always assured, dependent upon strap and chair material characteristics. In addition, the strap is not designed to wrap around an open arm rest of a chair.

U.S. Pat. No. 2,647,716 to A. I. Hudziak et al (Aug. 4, 1953), the chair tray is installed to one chair arm and the rigid engaging brackets of the chair tray require the chair arm to have solid sides. In addition, the brackets are not designed to go completely or wrap around an open arm rest of a chair.

U.S. Pat. No. 2,867,401 to H. L. Sheahan (Jan. 6, 1959), the adjustable chair arm gripping tray holder is attached to one chair arm. The rigid ratchet jaw fastening system used in this patent require the chair arm to have solid sides. The ratchet jaw is a complex and expensive system to produce. In addition, the ratchet jaw is not designed to go completely or wrap around an open arm rest of a chair.

U.S. Pat. No. 3,185,113 to J. I. Nathan et al (May 25, 1965), the invention is installed to one chair arm and the rigid gripping elements of the invention require the chair arm to have solid sides. The gripping elements are not designed to go completely or wrap around an open arm rest of a chair. Also, the invention is a complex and expensive system to produce.

OBJECTS AND ADVANTAGES

The principal object of this invention is to provide a secure and rigid utility surface between the armrests of a chair, which is supported by and secured to both armrests of the chair by means of a flexible strap fastener arrangment. The flexible strap fastener arrangement secures the tray to the chair by wrapping around the open armrests of the chair and fastening to underside of tray.

Accordingly, besides the principal object and advantage of the invention described, additional objects and advantages are:

(a) to provide a flexible strap fastener arrangement which will allow securing the tray to a wide range of chair and chair arm sizes.

(b) to provide a lightweight, durable utility tray for use on portable folding chairs when no comparable utility surface, such as table, is available.

(c) to provide ease of tray disengagement from the chair by simply releasing the flexible strap fastener from one or both arms of chair and lifting tray out of place.

(d) to provide a means of securing the tray to a portable chair which is folded for ease and compactness when carrying or storing chair.

(e) to provide a tray whereby the flexible strap fasteners may be fully secured to the tray itself. This provides compactness for storage and handling. It also allows the tray to utilized as a standard serving tray.

(f) an advantage of this invention is the simplicity of design and materials. The invention can be easily produced at very low cost using common materials.

(g) an advantage of the invention is the flexibility of installation. The tray may be secured to any horizontal structural supports which are within the spacing and length parameters of the tray and flexible strap fasteners.

For the specification, hook and loop and buckle type hardware will be use to illustrate the flexible strap fastener arrangement, with the understanding, however, that the flexible strap fastener arrangement is not limited to the use of only hook and loop or buckle type hardware.

Further objects and advantages of this invention will become apparent from a consideration of the drawings and ensuing description of it.

IN THE DRAWINGS

In describing the article and application, like reference numerals are used to designate like parts throughout several views.

REFERENCE NUMERALS IN DRAWINGS

Figure 1:
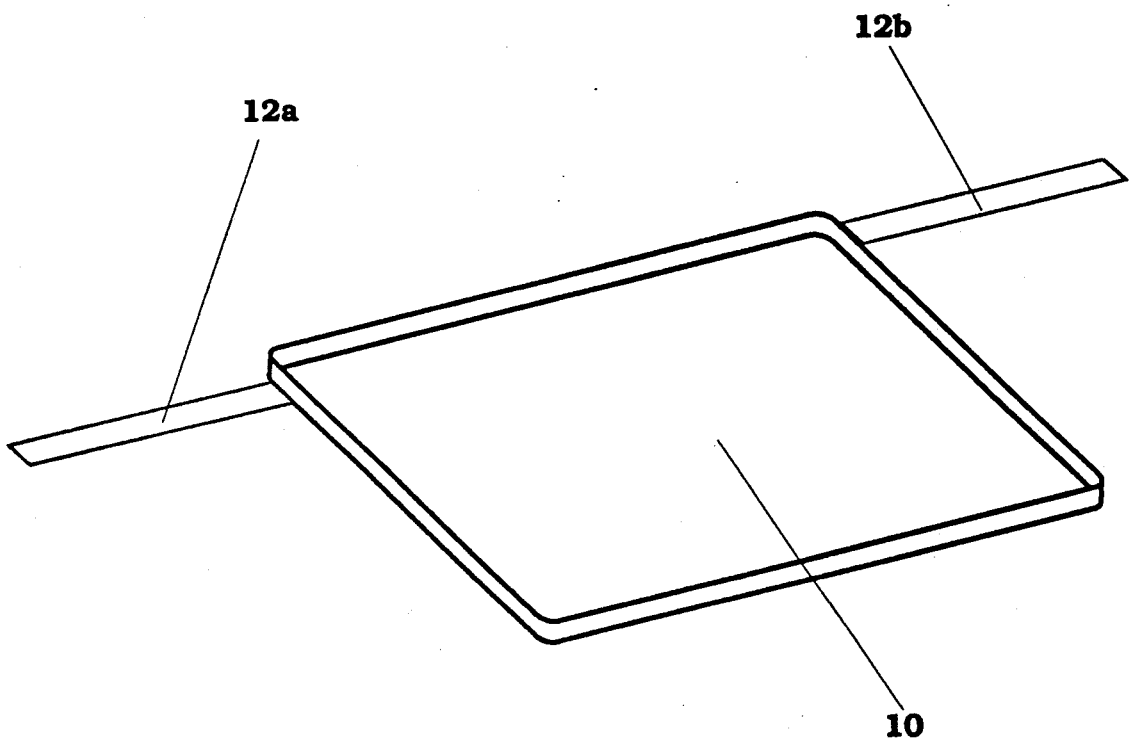
FIG. 1 is a perspective view of the utility tray and flexible strap fasteners.

10 utility tray
**12*b*** flexible fastener
20 chair
**22*b*** chair armrest
**12*a*** flexible fastener
14 fixed fastener
**22*a*** chair armrest

DESCRIPTION

In the drawings, 10 indicates a tray configuration or equivalent rigid utility surface which may be varied in size, shape, color, or material.

Figure 2:
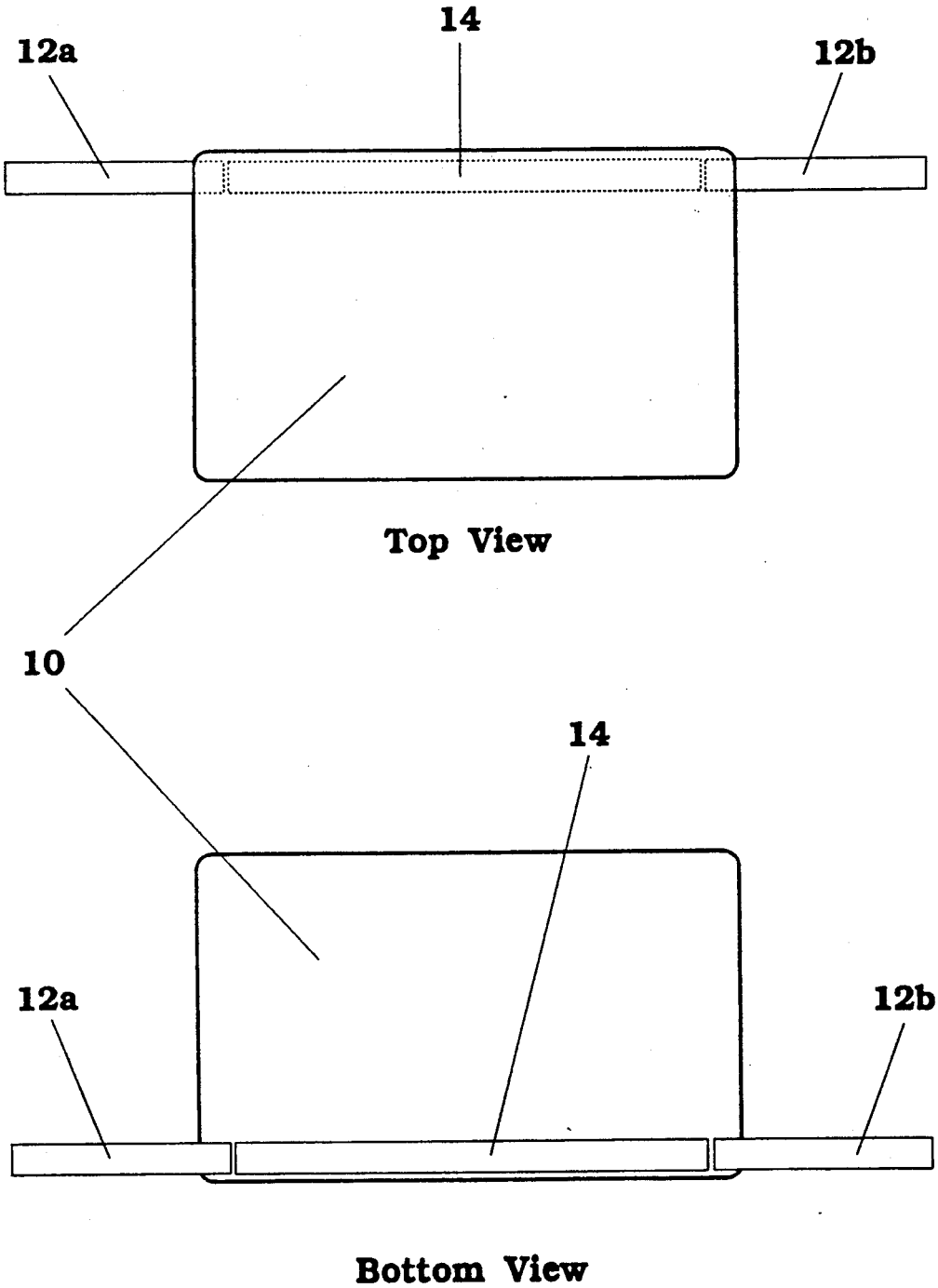
FIG. 2 is a top and bottom view of the utility tray and flexible strap fasteners.

Permanently attached by one end to the underside corners and adjacent and parallel to the back edge of the tray 10, are two diametrically opposite flexible strap fasteners **12*a*, 12*b* as shown in FIGS. 1 and 2**. The flexible strap fasteners may be varied in size, shape, color, or material.

Permanently attached to the underside and adjacent and parallel to the back edge of the tray 10, centered between and in line with the flexible strap fasteners 12*a*, 12*b*, is a fixed fastener 14 as shown in FIG. 2. The fixed fastener may be varied in size, shape, color, or material.

OPERATION

Figure 3:
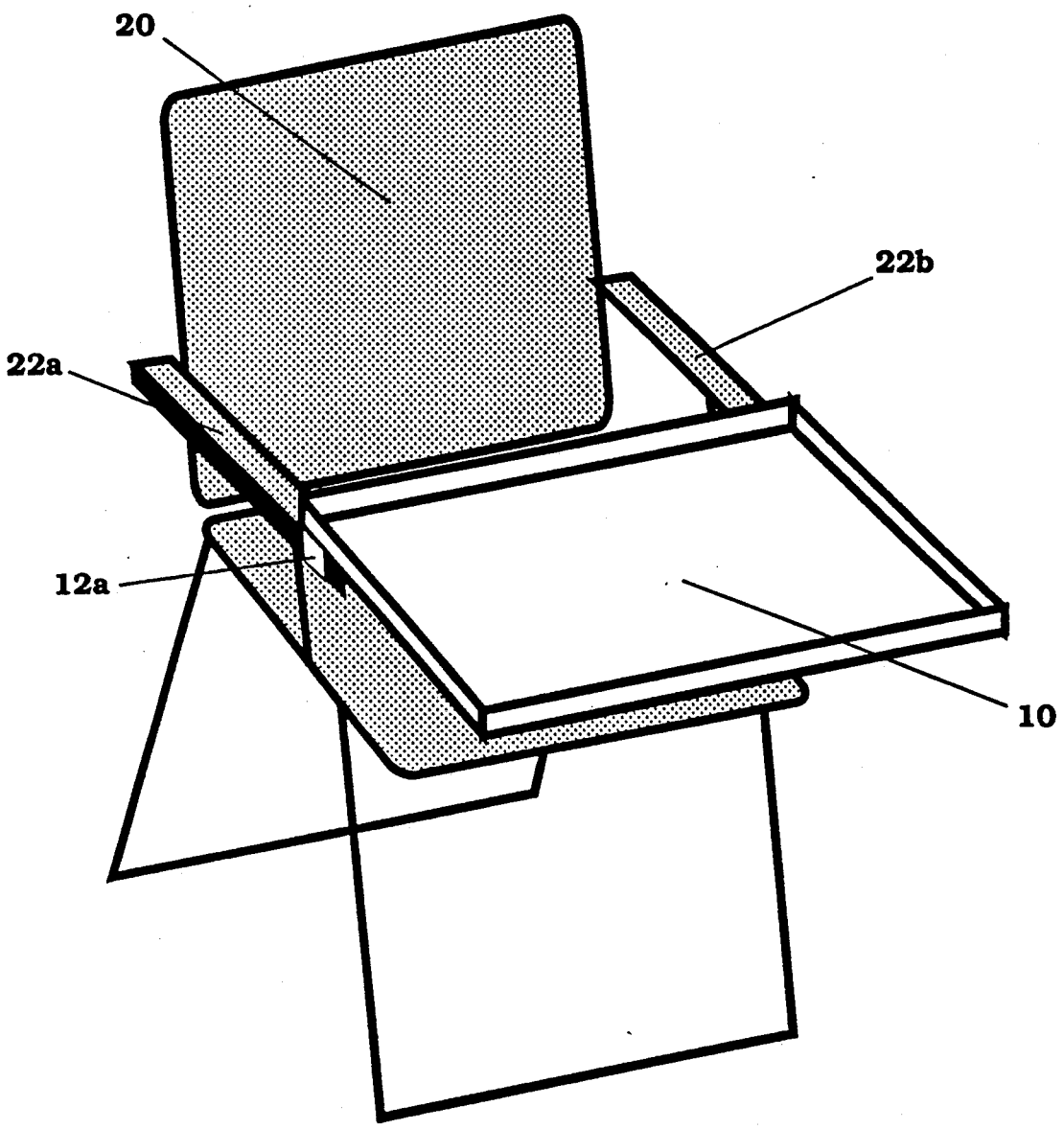
FIG. 3 is a perspective view of the utility tray as installed on a chair and secured to chair arms by the flexible strap fasteners.
Figure 4:
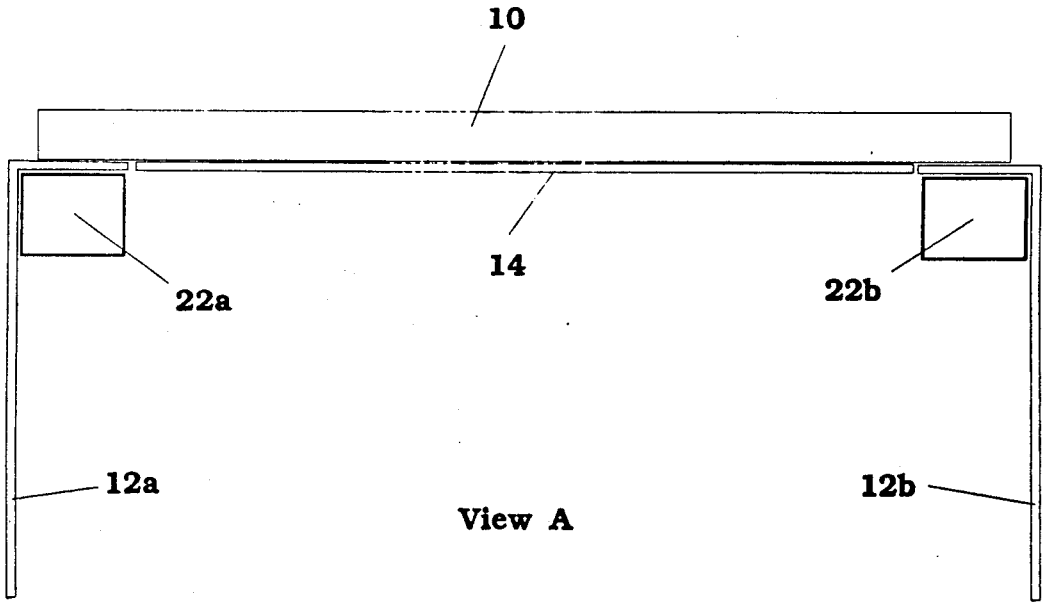
FIG. 4 is a front view of utility tray installation onto chair arms detailing flexible strap fastener engagement using hook and loop fasteners, commonly known as Velcro ®, a registered trademark of Velcro USA, Inc.
Figure 4:
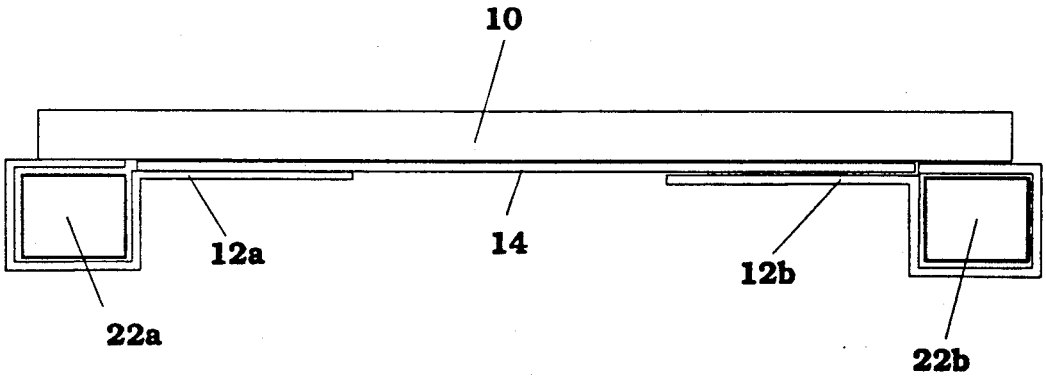
Figure 5:
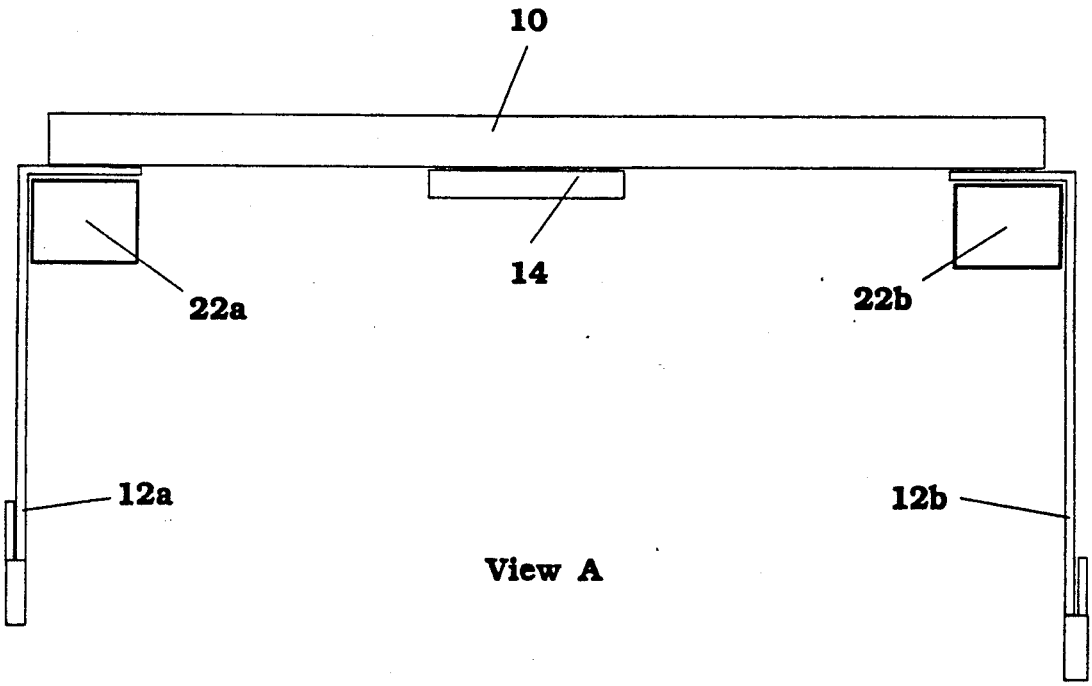
FIG. 5 is a front view of utility tray installation onto chair arms detailing flexible strap fastener engagement using buckle type hardware.
Figure 5:
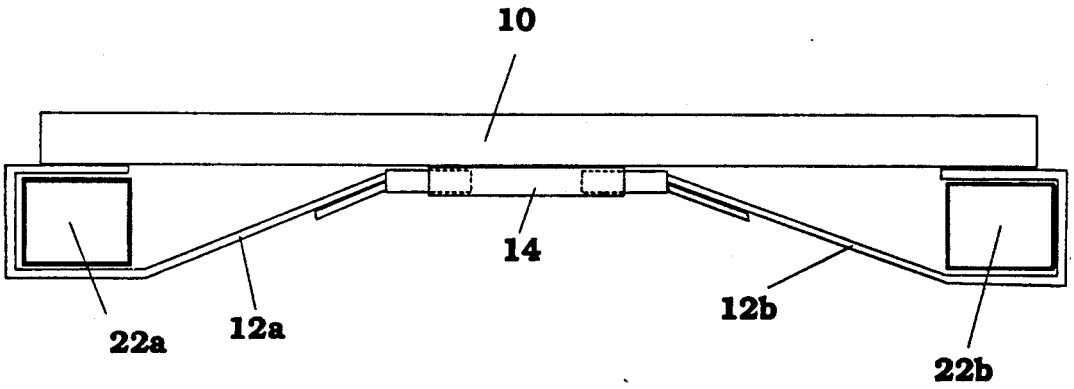

In the use and operation of this invention, the flexible strap fasteners 12*a*, 12*b* must first be disengaged from the fixed fastener 14 on tray 10. Tray 10 is placed on top of both chair armrests 22*a*, 22*b* with back edge of Tray 10 parallel to chair 20 back support as shown in FIGS. 3,4 and 5. The flexible strap fasteners 12*a*, 12*b* must be positioned over the outside edges of chair armrests 22*a*, 22*b* as shown in FIG. 4 view A and FIG. 5 view A. The flexible strap fasteners 12*a*, 12*b* are pulled underneath and wrapped around the chair armrests 22*a*, 22*b*. The flexible strap fasteners 12*a*, 12*b* are secured to the fixed fastener 14 as shown in FIG. 4, view B and FIG. 5, view B. The flexible strap fasteners are adjusted and tightened as required to secure tray 10 to chair armrests 22*a*, 22*b*.

CONCLUSION, RAMIFICATIONS, AND SCOPE OF INVENTION

As evident by the specification, the reader will see that the utility tray with flexible strap fasteners can be conveniently used on folding or fixed chairs with open armrests or any horizontal structural supports within the size parameters of the invention. The versatility and adjustable feature of the flexible strap fasteners allow attachment of the utility tray to a wide variety of chair types and sizes. Furthermore, the invention has additional advantages in that:

- it provides a secure and rigid utility surface between the arms of a chair.
- it is simple and easy to secure to the arms of a chair using the flexible strap fasteners.
- it is easy to remove from a chair by simply releasing flexible strap fastener(s).
- it can be attached to a folded chair for compactness and ease in carrying.
- it is compact thereby requiring minimum storage space.
- it can be used by both adults and children.
- it is a simple design and is easy to produce at low cost.

I claim:

1. An article of manufacture for supporting objects comprising: a rigid support surface, said rigid support surface having a substantially flat horizontal underside and having a back longitudinal edge, said underside having opposing corners; means for securing said rigid support surface to horizontal structural members, said securing means including two separate and diametrically opposite flexible strap fasteners, each said strap fastener being attached by one end to said underside at a respective one of said opposing corners, and each said strap fastener extending parallel and adjacent to said back longitudinal edge, said securing means also including a fixed fastener attached to said underside and being adjacent and parallel to said back longitudinal edge, said fixed fastener being located at a position centered between and in line with said strap fasteners; said support surface being supported by said horizontal structural members, said flexible strap fasteners encircling said horizontal structural members and engaging said fixed fastener, whereby opposing force of the engaged strap fasteners against said horizontal structural members secures said support surface to said horizontal members.

2. An article of manufacture as set forth in claim 1, wherein a surface of each strap fastener opposing the underside of said support surface is a hook type material for fastening to said fixed fastener.

3. An article of manufacture as set forth in claim 2, wherein a surface of said fixed fastener is a loop type material for fastening to said hook type material.

4. An article of manufacture as set forth in claim 1, wherein said strap fastener includes buckle type hardware on a free end thereof for being fastened to said fixed fastener.

5. An article of manufacture as set forth in claim 4, wherein said fixed fastener includes buckle type hardware for fastening to said buckle type hardware of said strap fastener.

* * * * *